US005918562A

United States Patent [19]

Macchio

[11] Patent Number: 5,918,562

[45] Date of Patent: Jul. 6, 1999

[54] BOAT WITH DUAL SKIS

[76] Inventor: Steven J. Macchio, 19 Talon Way, Dix Hill, N.Y. 11746

[21] Appl. No.: 08/878,045

[22] Filed: Jun. 18, 1997

[51] Int. Cl.[6] ..... B63B 1/18

[52] U.S. Cl. ..... 114/283; 114/61

[58] Field of Search ..... 114/61, 56, 283, 114/284, 271, 274; D12/300, 304, 310–313

[56] References Cited

U.S. PATENT DOCUMENTS

| | | | |
|---|---|---|---|
| Re. 31,563 | 4/1984 | Stout et al. . | |
| Re. 33,359 | 10/1990 | Lang | 114/283 |
| 3,013,515 | 12/1961 | Morel . | |
| 3,016,864 | 1/1962 | Woodfield . | |
| 3,157,146 | 11/1964 | Billig | 114/283 |
| 3,308,780 | 3/1967 | Abramson . | |
| 3,528,380 | 9/1970 | Yost . | |
| 3,987,743 | 10/1976 | Pensel . | |
| 3,998,176 | 12/1976 | Stout et al. | 114/283 |
| 4,067,286 | 1/1978 | Stout et al. . | |
| 4,669,408 | 6/1987 | Schad . | |
| 4,690,086 | 9/1987 | McKenna | 114/61 |
| 4,821,663 | 4/1989 | Schad . | |
| 4,861,292 | 8/1989 | Griffiths et al. . | |
| 4,872,859 | 10/1989 | Griffiths et al. . | |
| 5,228,404 | 7/1993 | Gibbs | 114/61 |

FOREIGN PATENT DOCUMENTS

| | | | |
|---|---|---|---|
| 74198 | 3/1989 | Japan | 114/283 |
| 492046 | 9/1938 | United Kingdom | 114/271 |

*Primary Examiner*—Ed L. Swinehart

*Attorney, Agent, or Firm*—Nixon, Hargrave, Devans & Doyle LLP

[57] ABSTRACT

A boat in accordance with the present invention includes boat hull and a pair of elongated members or skis or a modification to a standard boat hull to add on a dual ski attachment to make it a dual ski boat. The hull has a port side, a starboard side, an aft and a bow. One of the elongated members is adjustably mounted to and extends along the port side of the hull and the other of the elongated members is adjustably mounted to and extends along the starboard side of the hull. Each of the elongated members is adjustable between a first, retracted position wherein the member is retracted into a first recess in and is substantially flush with the hull and a second, extended position wherein each of the members extends down below and at least one foot behind the aft of the hull. The elongated members each have a forward section and a rearward section. The forward section tapers to a forward point located above the rearward section and has a triangular, hull-like shape which is larger than a piece of the rearward section of comparable length. The elongated members also may have a wedge extending away from the bottom surface of each elongated member and located adjacent an inner edge. The wedge extends along at least a portion of the bottom surface.

21 Claims, 5 Drawing Sheets

BOAT WITH DUAL SKIS

FIELD OF THE INVENTION

This invention relates generally to a boat and, more particularly, to a boat with a pair of adjustable skis or a modification to a standard boat hull to add on a dual ski attachment to make it a dual ski boat.

BACKGROUND OF THE INVENTION

A variety of different types of boats with dual skis have been developed over the years. Although the skis on these boats generally help to improve the boat's speed, stability and maneuverability, there continues to be room for improvement.

For example, one area for improvement is in the stability of boats with dual skis. In several prior designs, the forward end of each ski has substantially the same size and shape as the rest of the ski and the forward end of each ski terminates at a substantially "blunt" or flat front end. This design for the skis causes several problems. When the skis in these boats are deployed, the front end of these skis have a tendency to submerge and the blunt or flat front end may catch in the water causing the boat to lurch forward. Additionally, once the skis are in the water, the blunt or flat front end of each ski creates unnecessary drag in the water. These problems can be very disconcerting to the boat operator and/or passengers. Some examples of boats with these types of skis are illustrated in U.S. Pat. No. 4,669,408 to Sched, U.S. Pat. No. 4,821,663 to Sched, U.S. Reissue Pat. No. 31,563 to Stout et al of U.S. Pat. No. 4,067,286, U.S. Pat. No. 3,308,780 to Abramson, which are herein incorporated by reference.

Another area for improvement is with the control and maneuverability of the boats with dual skis, particularly at high speeds. In several prior designs, the bottom surface on each ski is substantially flat. The flat bottom surface makes it difficult for the oat operator to accurately control the direction of the boat when the skis are deployed because the skis do not "grip" the water. Accordingly, the boat has a "sloppy" feel when the boat operator tries to change the direction of the boat. Some examples of boats with these types of skis are illustrated in U.S. Pat. No. 4,669,408 to Sched, U.S. Pat. No. 4,821,663 to Sched, U.S. Reissue Pat. No. 31,563 to Stout et al of U.S. Pat. No. 4,067,286, U.S. Pat. No. 3,308,780 to Abramson, which are herein incorporated by reference.

SUMMARY OF THE INVENTION

A boat in accordance with the present invention includes boat hull and a pair of elongated members or skis. The hull has a port side, a starboard side, an aft and a bow. One of the elongated members is adjustably mounted to and extends along the port side of the hull and the other of the elongated members is adjustably mounted to and extends along the starboard side of the hull. Each of the elongated members is adjustable between a first, retracted position wherein the member is retracted into a first recess in and is substantially flush with the hull and a second, extended position wherein each of the members extends down below and at least one foot behind the aft of the hull. The elongated members each have a forward section and a rearward section. The forward section tapers to a forward point located above the rearward section and has a triangular, hull-like shape which is larger than a piece of the rearward section of comparable length. The elongated members may also have a wedge extending away from the bottom surface of each elongated member and located adjacent an inner edge. The wedge extends along at least a portion of the bottom surface.

The boat with dual elongated members or skis in accordance with the present invention provides a number of advantages. For example, one feature of the invention is the enlarged, triangular, hull-like shape of the forward section which prevents the elongated members from submerging when deployed and has a streamlined design to "knife" through the water. As a result, the boat is more stable and the forward section does not create any unnecessary drag or instability. Another feature of the invention is the triangular wedge located adjacent an inner edge of the bottom surface of each elongated member which helps to stabilize the boat and makes the boat easier to control and turn. Yet another feature of the invention is adjustability of the elongated members between a retracted position substantially flush against the hull where the elongated members become an active part of the hull to an extended position below and at least a foot behind the aft of the boat which helps to provide proper support and stability for the boat.

DETAILED DESCRIPTION

Figure 1:
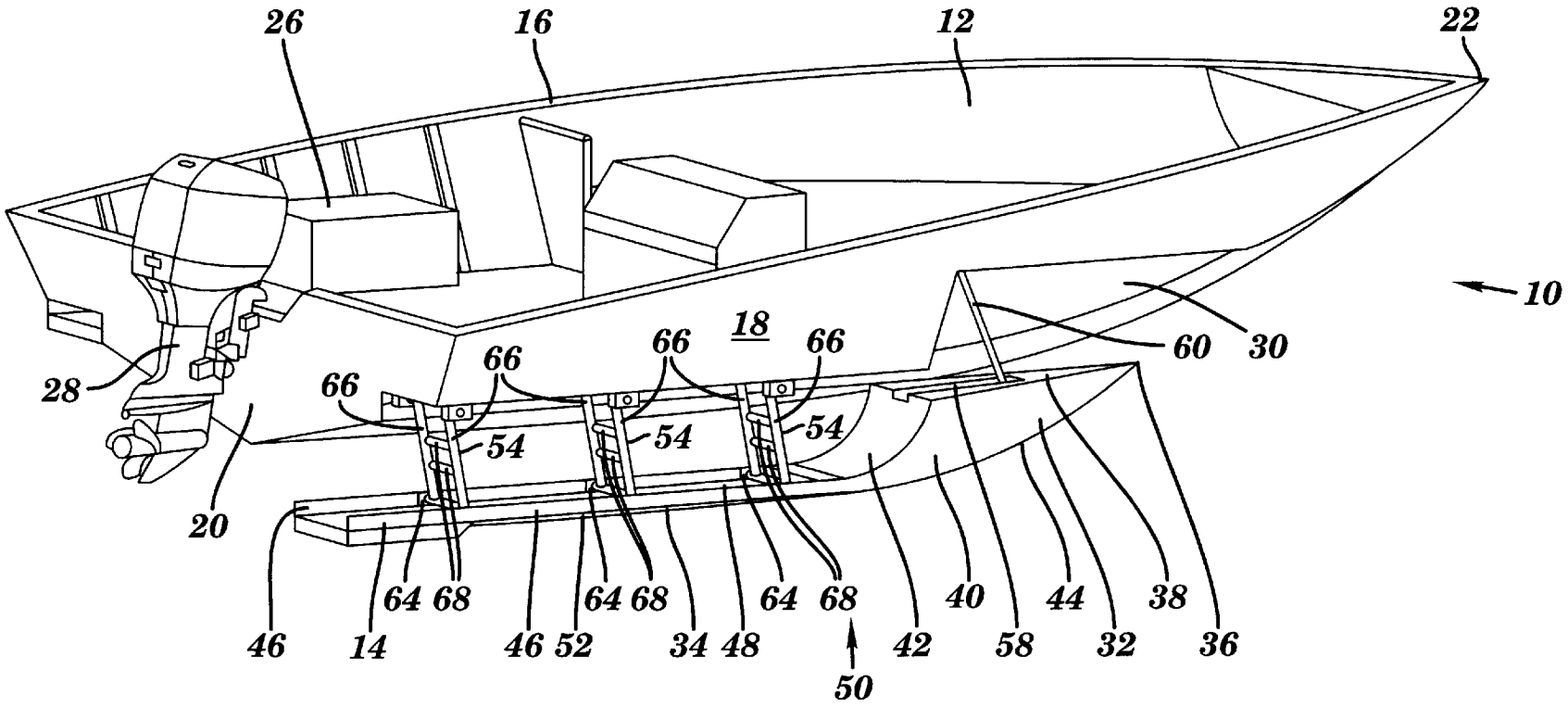
FIG. 1 is a perspective view of a boat with a pair of elongated members or skis in accordance with the present invention.

A boat 10 in accordance with the present invention includes a hull 12 and a pair of elongated members 14 or skis as illustrated in FIG. 1. The boat 10 with the dual elongated members 14 provides a number of advantages, including improving the stability, maneuverability, and speed of the boat over prior boat 10 designs with dual skis.

Figure 2:
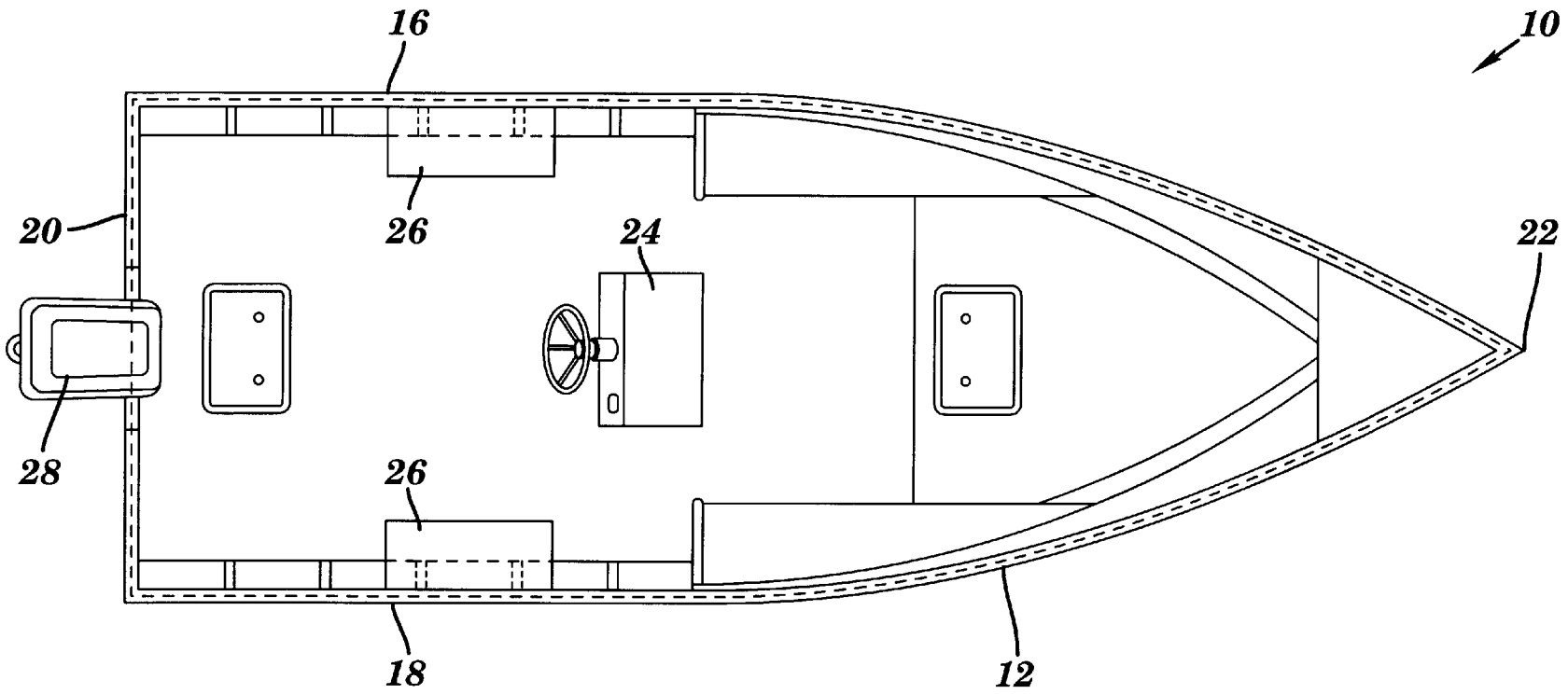
FIG. 2 is a plan view of the boat.
Figure 3A:
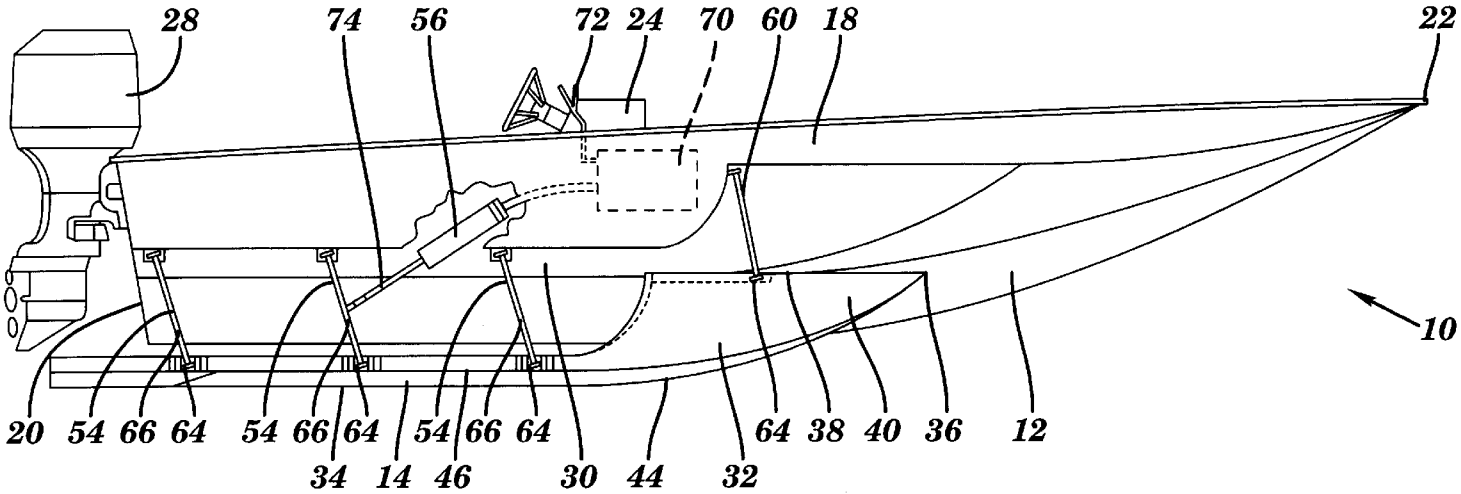
FIG. 3A is a side view of the boat with one elongated member extended.
Figure 3B:
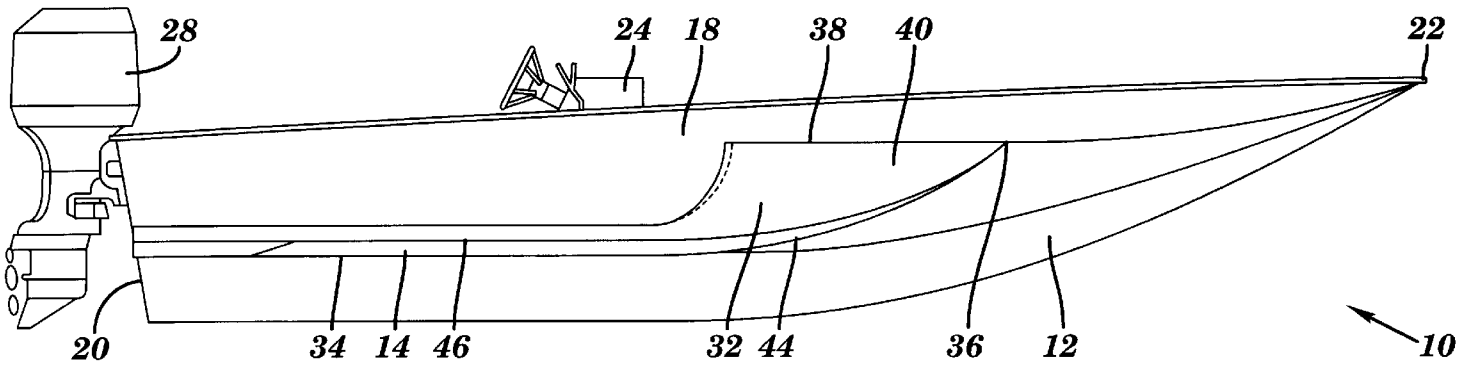
FIG. 3B is a side view of the boat with one elongated member retracted.
Figure 5:
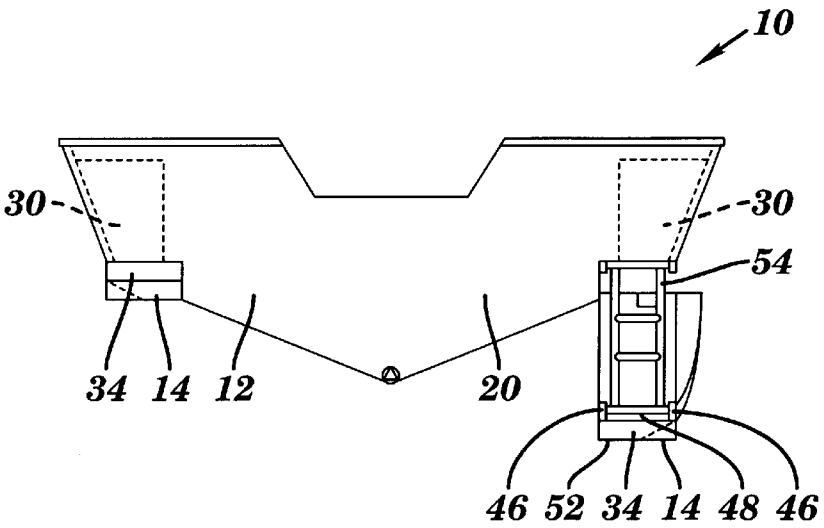
FIG. 5 is a rear view of the aft of the boat with one elongated member extended and one elongated member retracted.
Figure 4:
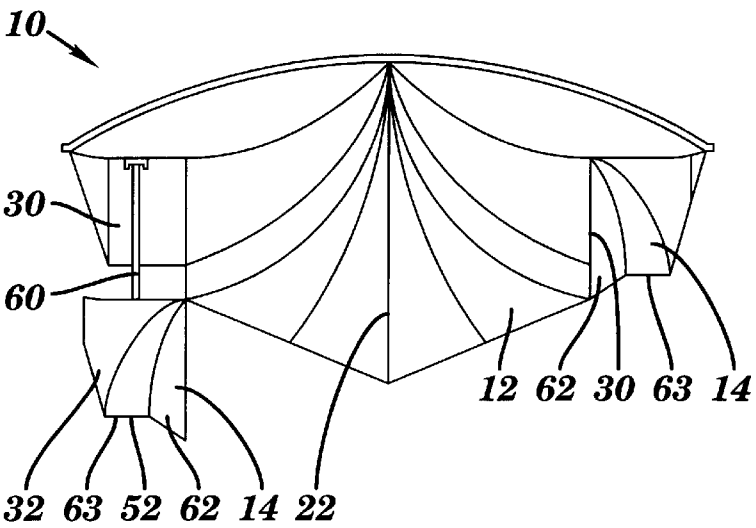
FIG. 4 is a front view of the bow of the boat with one elongated member extended and one elongated member retracted.

Referring to FIGS. 1 and 2, the port side 16, starboard side 18, aft 20 and bow 22 of the boat 10 are illustrated. The hull 12 of the boat 10 houses the bridge 24, seats 26, outboard engine 28, and other parts of the boat. Since the standard parts of a boat 10 are well known to those of ordinary skill in the art, they will not be described in detail here. As shown in FIGS. 4 and 5, the hull 12 has a substantially V-shape in this particular embodiment, although the shape of the hull 12 can vary as needed or desired. As shown in FIGS. 1, 3A, 4, and 5, a pair of recesses or indentations 30 are formed along the port and starboard sides 16 and 18 of the hull 12. The recesses 30 are designed to receive the fully retracted elongated members 14. As shown in FIGS. 3B, 4, and 5, when elongated members 14 are fully retracted they are substantially flush with the V-shaped hull 12. In this particular embodiment, hull 12 has a twenty-five degree deadrise and is constructed from aluminum although the degree of deadrise and the material hull 12 is constructed from can vary.

Figure 6A:
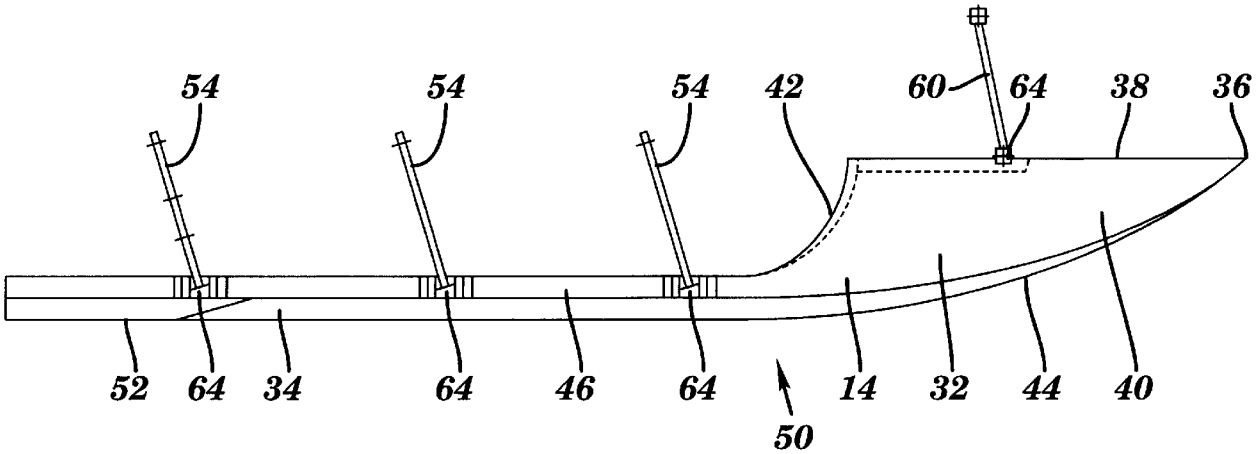
FIG. 6A is a side view of one elongated member.
Figure 6B:
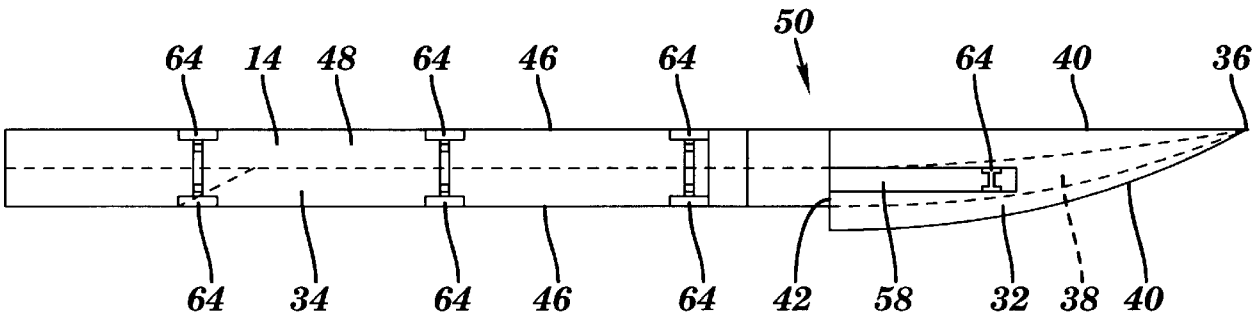
FIG. 6B is a plan view of one elongated member.

Referring to FIGS. 1, 3A, 3B, 4, 5, 6A, 6B, and 6C, elongated members 14 are illustrated. Each of the elongated members 14 has a forward section 32 and a rearward section 34. As shown in FIGS. 6A and 6B, forward section 32 has an enlarged, triangular, hull-like shape which tapers to a forward point 36. The forward point 36 is located above the waterline when boat 10 is in the water (even when the elongated members 14 are fully extended) and above the rearward section 34. The forward section 32 has a top surface 38 with a triangular-like shape which is connected to two side surfaces 40 with a triangular-like shape and a back surface 42. The side surfaces 40 slope down to meet along a bottom edge 44 and also towards opposing side surfaces 46 on the rearward section 34. The back surface 42 of the forward section 32 slopes down to a top Surface 48 of the rearward section 34. The width of the top surface 38 of the forward section 32 is larger than the width of the top surface 48 of the rearward section 34 at the location 50 where the forward and rearward sections 32 and 34 meet. Additionally, the height of the forward section 32 from bottom edge 44 to top surface 38 at the location where the forward and rearward sections 32 and 34 meet is larger than the height of the side surfaces 46 of the rearward section 34. In this particular embodiment, the top surface 38 of the forward section 32 is about eighteen inches above the top surface 48 of the rearward section although this height can vary. Additionally, in this particular embodiment, the elongated members 14 are made of aluminum and are filled with a floatation material, although other materials such as fiberglass can be used and floatation material can be left out.

As discussed above, forward section 32 is designed to stay at least partially above the waterline, even when deployed, and is designed to have a triangular, hull-like shape. As a result, forward section 32 does not "catch" in the water when deployed lurching the boat forward. Instead, the design of forward section 32 permits a smooth and stable transition when deployed and enables elongated members 14 to "knife" through the water.

The rearward section 34 has a substantially rectangular trough-like shape with a bottom surface 52, the pair of opposing side surfaces 46, and the top surface 48. Top surface 48 and the inside of side surfaces 46 form a rectangular trough which is designed to receive struts 54 which connect elongated members 14 to the hull 12. The side surfaces 46 have a height from the top surface 48 of rearward section 34 to the top edge of each side surface 46 which is equal to or greater than the width of each of the struts 54. As a result, struts 54 and the hydraulic cylinder 56 can nest within the trough of the rearward section 34 when the elongated members 14 are fully retracted in the hull 12. The top surface 48 of the forward sections 34 also includes an indentation 58 to receive the driving strut 60 when the elongated members 14 are fully retracted.

Figure 6C:
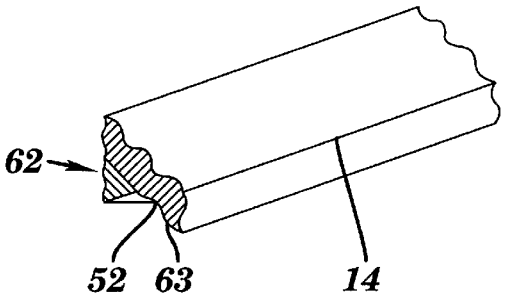
FIG. 6C is a perspective end view of a section of the elongated member with the wedge on the bottom surface.

Referring to FIGS. 4, 6A, and 6C, a wedge 62 extends away from the bottom surface 52 of each elongated member 14. The wedge 62 is located adjacent an inside edge (i.e. facing the boat 10) and extends along a portion of bottom surface 52. Wedge 62 on bottom surface 52 helps the boat 10 to "grab" the water, thus providing more stability and more accurate control. A substantially flat planing surface 63 is located adjacent the wedge 62 and extends over to the outside of elongated member 14 and runs along at least a portion of the length of elongated member 14. The substantially flat surface adjacent the rear of elongated member 14 provides a high speed planing surface.

Referring to FIGS. 1, 3A, 4, 5, and 6A, the elongated members 14 are adjustably mounted to the port and starboard sides 16 and 18 of the hull 12, respectively, by struts 54 and 60 or legs. In this particular embodiment, there are three struts 54 pivotally connecting the rearward section 34 of each elongated member 14 to the hull 12 and one drive strut 60 pivotally connecting the forward section 32 to the hull 12, although the number of struts 54 and 60 can vary as needed or desired. Struts 54 and 60 are pivotally connected at each end to bushing blocks 64 secured to the hull 12 and elongated members 14, respectively. In this particular embodiment, each strut 54 has a pair of side bars 66 which are connected together by a pair of connecting bars 68. The ends of the side bars 66 are pivotally connected in the bushing blocks 64 on the hull 12 and elongated members 14, respectively.

Each of the elongated members 14 has a hydraulic cylinder 56 which is coupled between a strut 54 and the hull 12. The hydraulic cylinder 56 is also coupled to a hydraulic control system 70 which controls the operation of the hydraulic cylinder 56 in a manner well known to those of ordinary skill in the art. Control levers 72 from the bridge 24 are coupled to the hydraulic control system 70 and enable the boat operator to control when the elongated members 14 on each side of the hull 12 are extended or lowered. Each elongated member 14 can be separately controlled. One example of a hydraulic system 70 is illustrated in U.S. Pat. No. 3,308,780 to Abramson and also in U.S. Reissue Pat. No. 31,563 to Stout et al. which are herein incorporated by reference. Although a single hydraulic cylinder 56 is shown for each elongated member 14, more than one hydraulic cylinder 56 can be used. Additionally, other types of mechanisms and/or devices to raise and lower the elongated members 14 could be used, such as a pneumatic systems or screw worm and gear mechanism.

The operation of boat 10 will be discussed with reference to FIGS. 1, 2, 3A, 3B, 4, and 5. As shown in FIGS. 1, 3A, 4, and 5, when the operator engages the hydraulic system 70 (or other mechanism for moving the elongated members) the shaft 74 in the hydraulic cylinder 56 which has been activated pushes one of the struts 54 for the elongated member 14 down and away from the hull 12. The elongated member 14 driven away from the recess 30 in the hull 12 which causes the hull 12 to rise. The operator controls how far the elongated member 14 is extended. When the operator disengages the hydraulic system 70 via levers 72, the hydraulic system 70 locks the elongated member 14 into its present position. When the elongated member 14 is fully extended, elongated member 14 extends at least a foot past the aft 20 of the boat 10 and the hull 12 is raised. In this particular embodiment, elongated member 14 extends about two feet past the aft 20 of boat 10 and the hull 12 is raised about six inches above the waterline.

The boat operator can also reverse the process and activate the hydraulic system 70 to retract the elongated members 14. The shaft 74 is driven back into the hydraulic cylinder 56 which pulls the strut 54 for elongated member 14 back into the recess 30 in hull 12. Eventually, when the elongated members 14 are fully retracted, the struts 54 and 60 and hydraulic cylinder 56 nest within the elongated members 14 which nest within the recesses 30 in hull 12 and become part of the hull.

The operator can extend or retract one or both of the elongated members 14 during operation to adjust to a variety of different conditions. For example, during low speed operation the operator can lower the elongated members 14 for increased stability against port to starboard rolling.

During acceleration the operator can retract the elongated members 14 into recesses 30 in hull 12 to reduce drag. During high speed operation the operator can extend elongated members 14 to raise the majority of hull 12 out of the water, thus reducing drag and increasing the boat's speed. During turns the operator can adjust the amount each elongated member 14 is extended to add stability during turns. During normal cruising speeds the operator can extended elongated members 14 to different positions to compensate for uneven loading in the boat 10 or for rocking seas.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A boat comprising:

a hull having a port side, a starboard side, an aft end and a bow; and a pair of elongated members, one of the members adjustably mounted to and extending along the port side of the hull and the other of the members adjustably mounted to and extending along the starboard side of the hull;

each of the members adjustable between a first, retracted position wherein the member is retracted into a first recess in and is substantially flush with the hull and a second, extended position wherein each of the members extends down below the hull;

each of the elongated members having a forward section and a rearward section, wherein the forward section tapers to a forward point located above the rearward section, the forward and rearward sections each having a top surface and a pair of side surfaces, the top surface of the forward section having a larger width than the top surface of the rearward section at the location where the forward and rearward sections meet and the side surfaces of the forward section having a larger height than the side surfaces of the rearward section at the location where the forward and rearward sections meet.

2. The boat as set forth in claim 1 wherein each of the elongated members has a bottom surface with a wedge extending away from the bottom surface, the wedge being located adjacent an inner edge and extending along at least a portion of the bottom surface and a substantially flat planing surface adjacent the wedge.

3. The boat as set forth in claim 1 further comprising a means for adjusting the members between the first and second positions.

4. The boat as set forth in claim 3 wherein the means for adjusting comprises:

at least one strut for each of the elongated members, each of the struts mounted between a top surface of each of the members and the first recess for each of the elongated members in the hull; and at least one hydraulic cylinder for each of the elongated members, each of the hydraulic cylinders mounted between the hull and one of the struts for each of the elongated members.

5. The boat as set forth in claim 4 wherein the top surface of each of the elongated members has a second recess to receive the strut when the elongated member is in the first, retracted position.

6. The boat as set forth in claim 4 wherein the means for adjusting further comprises a control system for controlling each hydraulic cylinder separately.

7. The boat as set forth in claim 1 wherein each of the elongated members is filled with a flotation material.

8. A boat comprising:

a hull having a port side, a starboard side, an aft end and a bow; and a pair of elongated members, one of the members adjustably mounted to and extending along the port side of the hull and the other of the members adjustably mounted to and extending along the starboard side of the hull;

each of the elongated members adjustable between a first, retracted position wherein the member is retracted into a first recess in and is substantially flush with the hull and a second, extended position wherein each of the members extends down below the hull;

each of the elongated members having a bottom surface and a wedge extending away from the bottom surface, wherein the first recess in the hull includes a portion which receives the wedge so that the wedge is substantially flush with the hull in the first, retracted position.

9. The boat as set forth in claim 8 further comprising a means for adjusting the members between the first and second positions.

10. The boat as set forth in claim 9 wherein the means for adjusting comprises:

at least one strut for each of the elongated members, each of the struts mounted between a top surface of each of the members and the first recess for each of the elongated members in the hull; and at least one hydraulic cylinder for each of the elongated members, each of the hydraulic cylinders mounted between the hull and one of the struts for each of the elongated members.

11. The boat as set forth in claim 10 wherein the top surface of each of the elongated members has a second recess to receive the strut when the elongated member is in the first, retracted position.

12. The boat as set forth in claim 10 wherein the means for adjusting further comprises a control system for controlling each hydraulic cylinder separately.

13. The boat as set forth in claim 8 wherein each of the elongated members is filled with a flotation material.

14. A boat comprising:

a substantially V-shaped hull having a port side, a starboard side, an aft end and a bow; and a pair of elongated members, one of the members adjustably mounted to and extending along the port side of the hull and the other of the members adjustably mounted to and extending along the starboard side of the hull;

each of the elongated members adjustable between a first, retracted position wherein the member is retracted into a first recess in and is substantially flush with the hull and a second, extended position wherein each of the members extends down below and partially behind the aft end of the hull.

15. The boat as set forth in claim 14 wherein the forward section tapers to a forward point located above the rearward section, the forward and rearward sections each having a top surface and a pair of side surfaces, the top surface of the forward section having a larger width than the top surface of the rearward section at the location where the forward and rearward sections meet and the side surfaces of the forward section having a larger height than the side surfaces of the rearward section at the location where the forward and rearward sections meet.

16. The boat as set forth in claim 15 wherein each of the elongated members has a bottom surface with a wedge extending away from the bottom surface, the wedge being located adjacent an inner edge and extending along at least a portion of the bottom surface and a substantially flat planing surface adjacent the wedge.

17. The boat as set forth in claim 15 further comprising a means for adjusting the members between the first and second positions.

18. The boat as set forth in claim 17 wherein the means for adjusting comprises:

at least one strut for each of the elongated members, each of the struts mounted between a top surface of each of the members and the first recess for each of the elongated members in the hull; and at least one hydraulic cylinder for each of the elongated members, each of the hydraulic cylinders mounted between the hull and one of the struts for each of the elongated members.

19. The boat as set forth in claim 18 wherein the top surface of each of the elongated members has a second recess to receive the strut when the elongated member is in the first, retracted position.

20. The boat as set forth in claim 18 wherein the means for adjusting further comprises a control system for controlling each hydraulic cylinder separately.

21. The boat as set forth in claim 15 wherein each of the members extends at least one foot behind the aft end of the hull.

* * * * *